US007093524B2

(12) United States Patent
Hsieh

(10) Patent No.: US 7,093,524 B2
(45) Date of Patent: Aug. 22, 2006

(54) SCREWDRIVER STRUCTURE

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/950,299

(22) Filed: Sep. 27, 2004

(65) Prior Publication Data

US 2005/0045003 A1 Mar. 3, 2005

Related U.S. Application Data

(63) Continuation-in-part of application No. 10/299,714, filed on Nov. 20, 2002, now abandoned.

(51) Int. Cl.
*B25G 1/00* (2006.01)

(52) U.S. Cl. ..... 81/492; 81/436; 81/177.5

(58) Field of Classification Search ..... 81/492, 81/489, 28, 436, 177.1, 177.5
See application file for complete search history.

(56) References Cited

U.S. PATENT DOCUMENTS 1,469,792 A * 10/1923 Johnson ..... 81/438
2,351,705 A * 6/1944 Prall ..... 81/436
2,849,041 A * 8/1958 Vetri ..... 81/177.1
5,590,575 A * 1/1997 Ludy ..... 81/177.5
5,823,078 A * 10/1998 Liu ..... 81/436
6,170,123 B1 * 1/2001 Holland-Letz ..... 81/436

* cited by examiner

*Primary Examiner*—Hadi Shakeri

(57) ABSTRACT

A screwdriver structure includes a handle having a projecting section at rear end, a circumference of the projecting section being formed with a predetermined number of holes extending into the interior of the projecting section; a stem disposed at front end of the handle; and a rotary cap having a cavity inward extending from a bottom end of the rotary cap, an outer circumference of the rotary cap being formed with several through holes communicating with the cavity. The rotary cap is rotatably disposed on the projecting section which is accommodated in the cavity with the through holes. When operating the screwdriver, the palm of a user's hand can attach to the rotary cap. When turning the rotary cap, at least one through holes is align with at least one holes. A rod can be inserted through the hole and the through hole to elongate the application force arm.

11 Claims, 5 Drawing Sheets

SCREWDRIVER STRUCTURE

The invention is continuation in part (CIP) of U.S. Patent Series No. 10,299,714, filed on Nov. 20, 2002, now abandoned, "Screwdriver Structure" invented and assigned to the inventor of the present invention. Thus the content of the invention is incorporated into the specification of the present invention as a part of the application.

BACKGROUND OF THE INVENTION

The present invention is related to a hand tool, and more particularly to a screwdriver which can be more conveniently operated. In addition, the screwdriver can be operated with higher torque. When not used, the screwdriver can be hung and well stored.

A conventional screwdriver without ratchet structure has a handle and a stem fixed at front end of the handle. A user can turn the handle to make the stem screw a screw member.

When operating such screwdriver, the user's hand must repeatedly turn back and forth so as to one-way rotate the handle. After clockwise rotating the screwdriver, the user's hand must release the handle and move back and then tightly hold the handle to clockwise turn the handle again. Such operation is inconvenient for the user.

Furthermore, it is necessary to exert a great force onto the screwdriver for tightening or untightening a screw, especially for untightening a rusting and clogging screw. In the above case, the user often fails to turn the handle simply with his hand to apply a sufficient force for screwing the screw.

Moreover, the conventional screwdriver lacks any hanging structure and is often randomly placed. Therefore, it often takes place that the user must take time to find the screwdriver when needed.

SUMMARY OF THE INVENTION

It is therefore a primary object of the present invention to provide a screwdriver which can be more conveniently operated. In addition, the screwdriver can be operated with higher torque. When not used, the screwdriver can be hung and well stored.

The present invention can be best understood through the following description and accompanying drawings wherein:

DETAILED DESCRIPTION OF THE PREFERRED EMBODIMENTS

Figure 1:
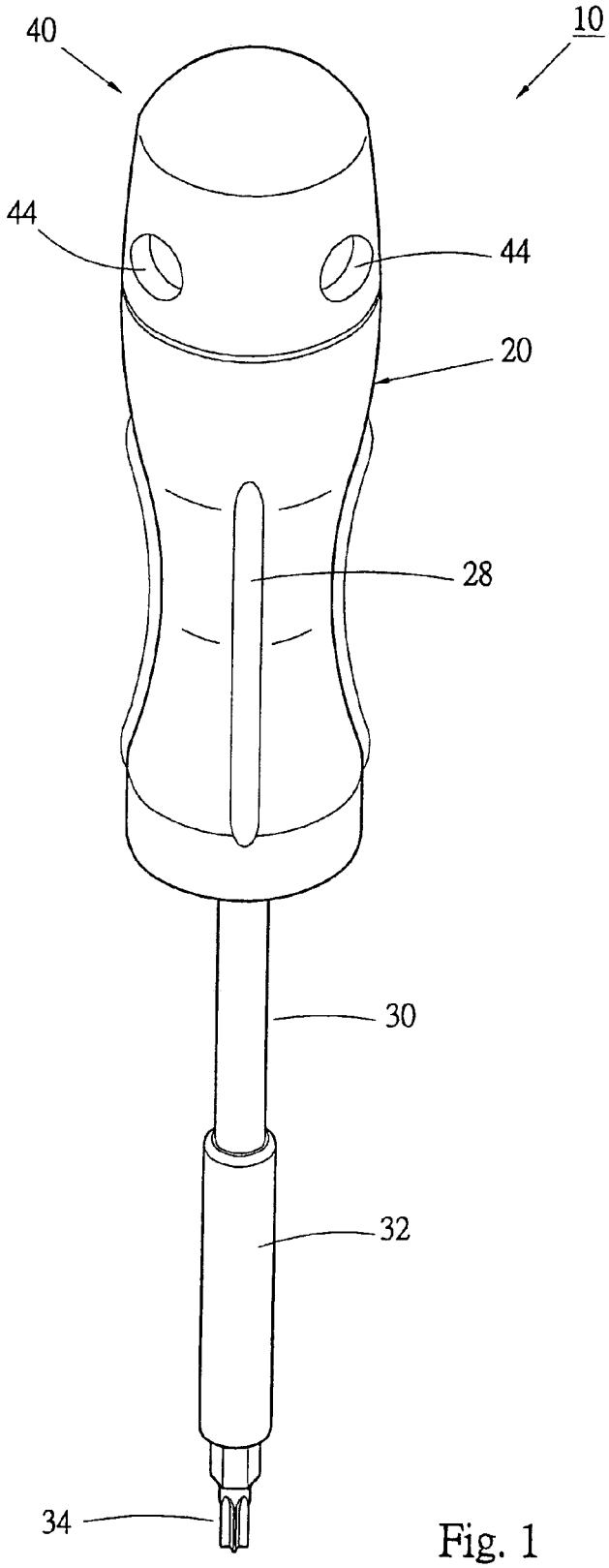
FIG. 1 is a perspective assembled view of a first embodiment of the present invention.
Figure 2:
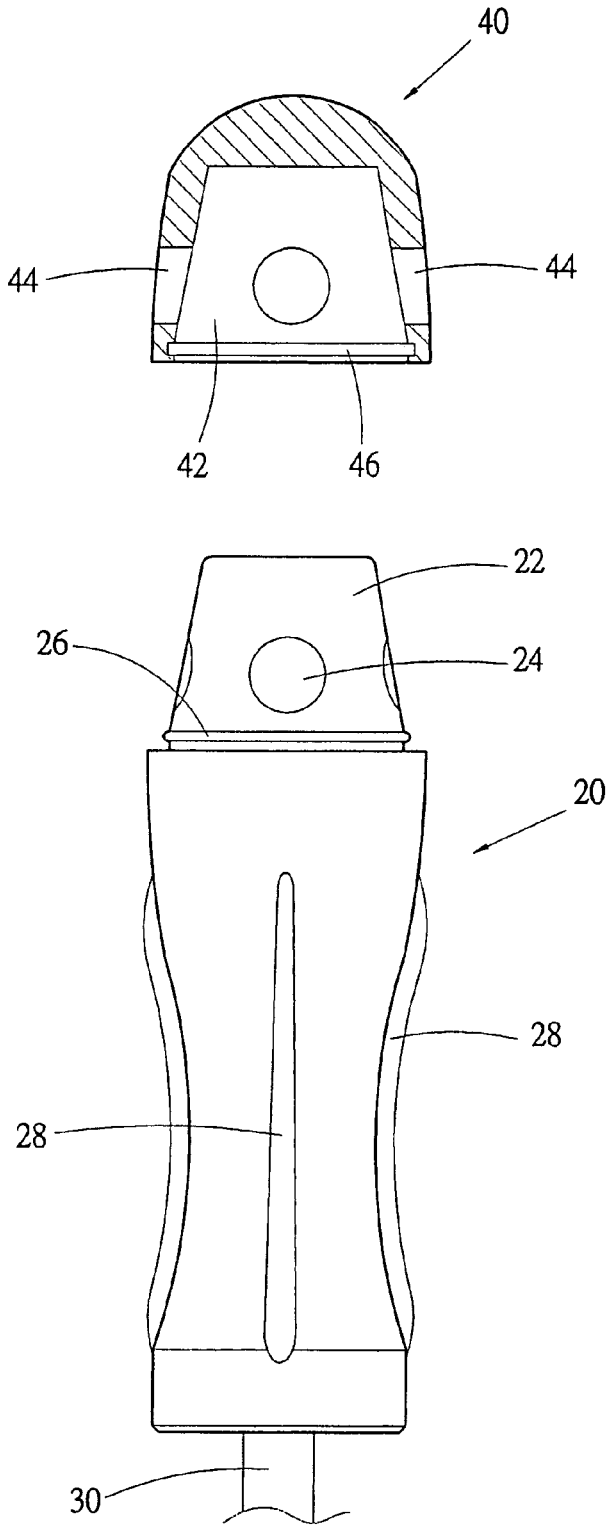
FIG. 2 is a front partially sectional exploded view of the first embodiment of the present invention.
Figure 6:
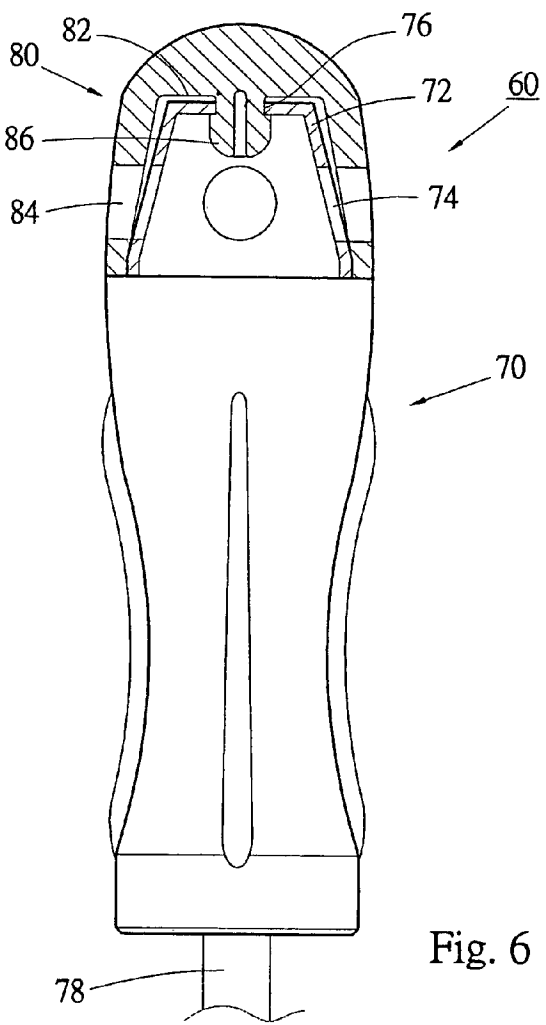
FIG. 6 is a longitudinal partially sectional view of a second embodiment of the present invention.

Please refer to FIGS. 1 and 2. According to a first embodiment, the screwdriver 10 of the present invention includes a handle 20, a stem 30 and a rotary cap 40.

Figure 3:
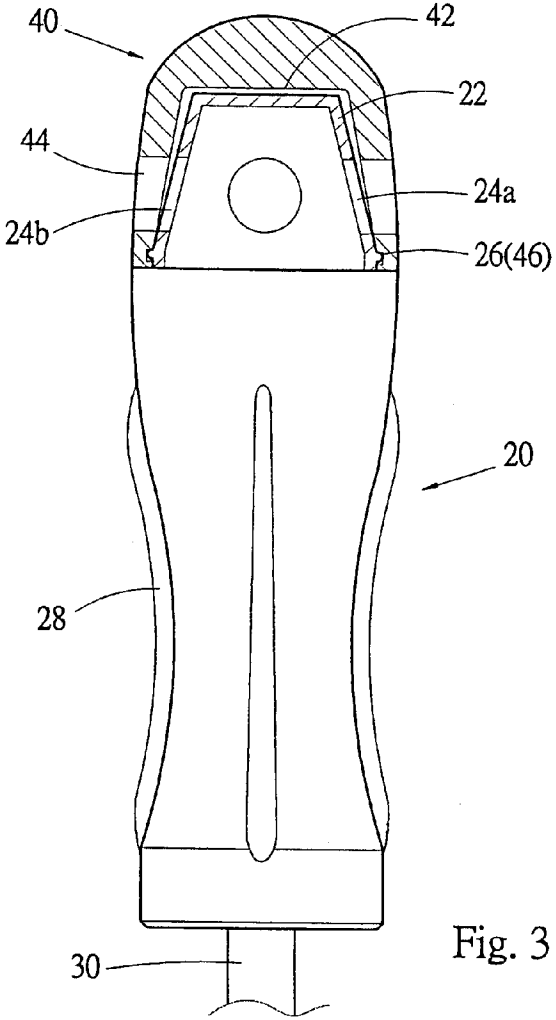
FIG. 3 is a longitudinal partially sectional view of the first embodiment of the present invention.

The rear end of the handle 20 is formed with a projecting section 22. The projecting section 22 has a frustrated conic shape. The circumference of the projecting section 22 is formed with several holes 24. For example, there are four holes 24 extending into an interior of the projecting section 22. An angle connected an axis of the hole 24 and an axis of the handle is great, for example, 90 degrees. In this embodiment, the number of the holes 24 is even. Therefore, as shown in FIG. 3, each two corresponding holes 24*a*, 24*b* of the circumference of the projecting section are collinear. In the case that the projecting section is solid, the two holes 24*a*, 24*b* in fact are a through hole passing from one side to the other side of the projecting section.

An engagement section 26 which is an annular rib is formed around the circumference of the projecting section 22. In addition, a plurality of axial ribs 28 are formed on the circumference of the handle in parallel to the axis of the handle.

The rear end of the stem 30 is fixedly connected with the front end of the handle 20. A screwdriver bit is directly disposed at the front end of the stem. Alternatively, as shown in FIG. 1, a socket section 32 is disposed at the front end of the stem for fitting with various types of screwdriver bits 34.

The rotary cap 40 has a cavity 42 inward extending from the bottom end of the rotary cap 40. The outer circumference of the rotary cap is formed with several through holes 44 communicating with the cavity 42. In this embodiment, each two corresponding through holes 44 are lined up. circumference of the cavity 42 the engagement section 46 of the rotary cap 40 is engaged with the engagement section 26 of the handle as shown in FIG. 3, whereby the rotary cap is rotatably disposed on the rear end of the handle. The projecting section 22 is accommodated in the cavity 42 with the through holes 44 corresponding with the holes 24 of the projecting section 22.

When operating the screwdriver 10, a user holds and turns the handle 20 in a direction (for example, clockwise) to screw a screw. The axial ribs 28 make the user more easily hold and force the handle. After turned by a certain angle, the user's hand can loosen the handle and turn back in a reverse direction (for example, counterclockwise). During turning back, the palm can attach to the rotary cap 40 which serves as a fulcrum, whereby the hand and the rotary cap can turn synchronously with the handle keeping still. After turning back by a certain angle, the user again holds the handle and turns the screwdriver. Accordingly, when the hand turns back, the palm will not totally separate from the handle.

Figure 4:
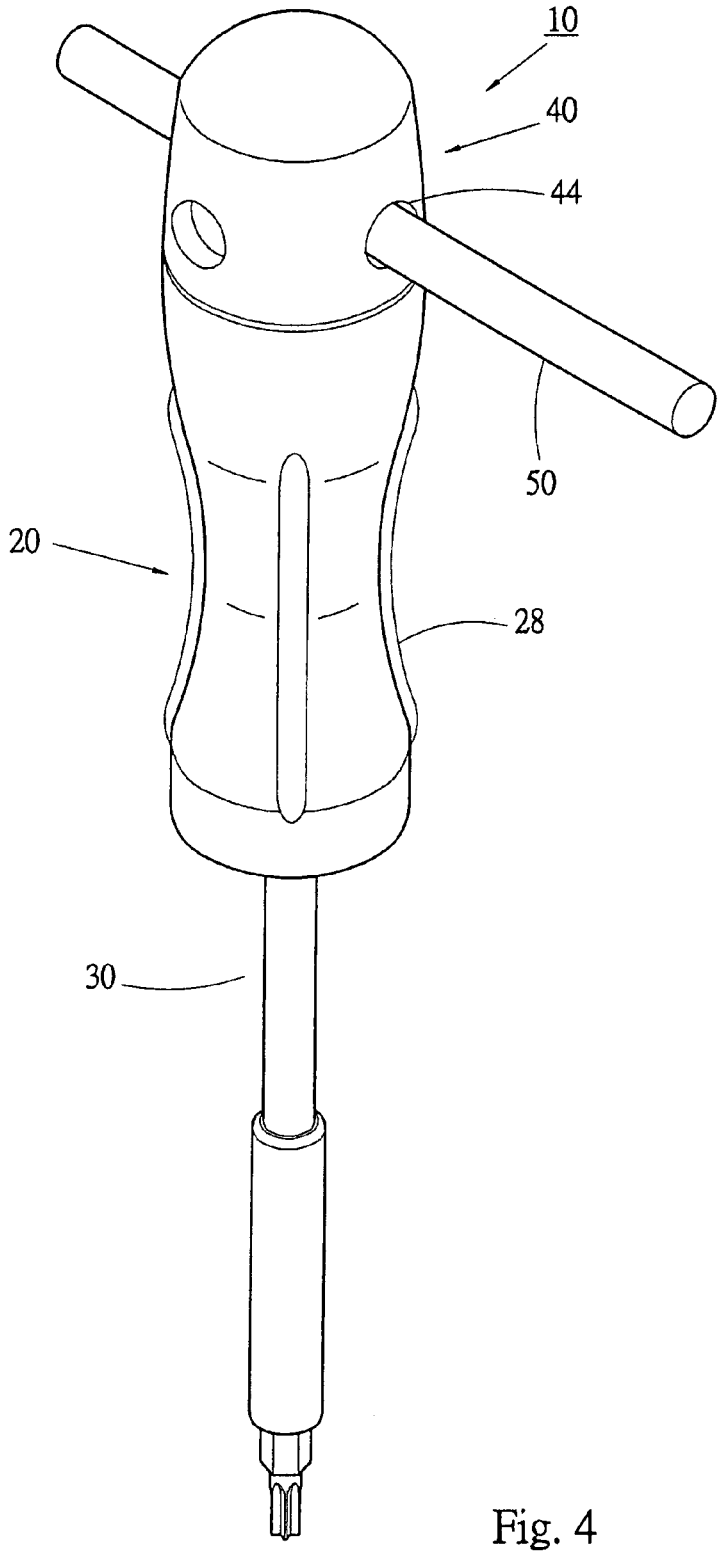
FIG. 4 shows that a rod member is inserted through the screwdriver of the present invention for increasing operation torque.

When it is necessary to turn the screwdriver with a greater torque, the user can turn the rotary cap 40 to align at least one through hole 44 of the rotary cap with at least one hole 24 of the projecting section 22 as shown in FIG. 3. Then, as shown in FIG. 4, a rod 50 is inserted through the through hole 44 and the hole 24 to form a force arm, whereby the user can exert a greater torque to turn the screwdriver.

Figure 5:
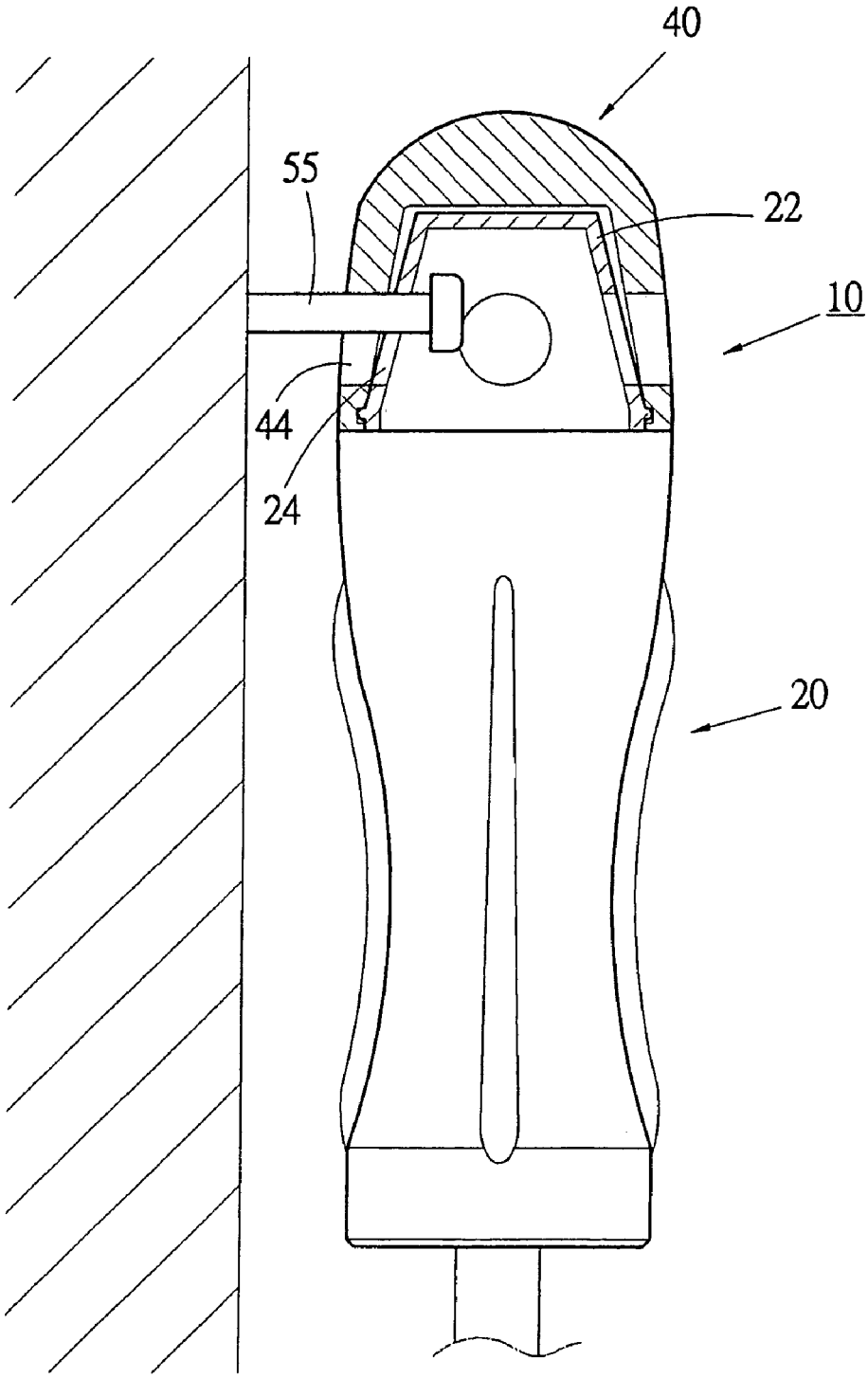
FIG. 5 shows that the screwdriver of the present invention is hung and stored.

After used, turn the rotary cap 40, at least one the through hole 44 of the rotary cap is aligned with at least one the hole 24 of the handle 20. As shown in FIG. 5, the screwdriver can be hung on a projecting article 55 on a wall face, such as a nail or a hanging hook. Accordingly, the screwdriver can be well stored. a top wall of the cavity 82. The engagement section 86 has a hollow inner cylinder section 861 so as to provide a compressing space in the installation process. The engagement section 76 is fitted into the engagement section 86, whereby the rotary cap 80 is freely rotatably disposed at the rear end of the handle 70.

The second embodiment can achieve the same effect as the first embodiment.

It should be noted that in the first embodiment, the positions of the annular rib and annular groove can be switched. That is, the annular groove is formed on the circumference of the projecting section, while the annular rib is formed on the wall of the cavity of the rotary cap. Similarly, in the second embodiment, the shaft column and the shaft hole can be switched.

According to the above arrangement, the present invention has the following advantages:

1. When a user operates the screwdriver and the user's hand turns back, the palm keeps in contact with the rotary cap without totally separating from the handle. Therefore, the operation is facilitated. Moreover, when the hand turns back, the screwdriver will not deflect or detach from the screw.
2. A rod can be inserted through the screwdriver to elongate the application force arm so as to increase the torque for turning the screwdriver.
3. The screwdriver can be hung and well stored for next use.

Although this inventions has been described with a certain degree of particularity, it is to be understood that the present disclosure has been mad by may of example only and that numerous changes in the detailed construction and the combination and arrangement of parts may be resorted to without departing from the spirit and scope of the invention as hereinafter claimed.

The invention claimed is:

1. Screwdriver structure comprising:

a handle, a rear end of the handle being formed with a projecting section, said projecting section having a frusto-conical shape; a circumference of the projecting section being formed with a predetermined number of holes at intervals, the holes extending into an interior of the projecting section, an angle being formed between an axis of each hole and an axis of the handle, an engagement section being formed at the projecting section;

a stem disposed at a front end of the handle for driving a screw; and a rotary cap having a cavity inward extending from a bottom end of the rotary cap, an outer circumference of the rotary cap being formed with a plurality of through holes communicating with the cavity, an engagement section being formed at the rotary cap, the engagement section of the rotary cap being engaged with the engagement section of the projecting section, whereby the rotary cap is rotatably disposed on the rear end of the handle, the projecting section being accommodated in the cavity, said through holes being corresponding to said holes; when turning the rotary cap, at least one said through holes being aligned with at least one said holes;

a predetermined number of ribs being formed on the circumference of the handle; the ribs being parallel to the axis of the handle; and said screwdriver being configured such that in operation a rod can pass through at least one through hole of the rotary cap and at least one hole of the projection section when a greater torque is required, and when not in use the screwdriver can be suspended on a projection by aligning the holes.

2. The screwdriver structure as claimed in claim 1, wherein the engagement section of the projecting section is an annular rib formed on the circumference of the projecting section, while the engagement section of the rotary cap is an annular groove formed on a wall face of the cavity, the annular rib being rotatably engaged in the annular groove.

3. The screwdriver structure as claimed in claim 2, wherein the rotary cap has four through holes, the projection sections has four holes and the handle has four axial ribs.

4. The screwdriver structure as claimed in claim 2, wherein the number of the through hole of the rotary cap is equal to the number of the holes of the axial ribs.

5. The screwdriver structure as claimed in claim 1, wherein the engagement section of the projecting section is an annular groove formed on the circumference of the projecting section, while the engagement section of the rotary cap is an annular rib formed on a wall face of the cavity, the annular rib being rotatably engaged in the annular groove.

6. The screwdriver structure as claimed in claim 5, wherein the rotary cap has four through holes, the projection sections has four holes and the handle has four axial ribs.

7. The screwdriver structure as claimed in claim 1, wherein the engagement section of the projecting section is a shaft hole formed on an end face of the projecting section, while the engagement section of the rotary cap is a shaft column having a reverse hook, the shaft column downward extending from top wall of the cavity, the shaft column being rotatably fitted in the shaft hole.

8. The screwdriver structure as claimed in claim 7, wherein the rotary cap has four through holes, the projection sections has four holes and the handle has four axial ribs.

9. The screwdriver structure as claimed in claim 1, wherein the engagement section of the projecting section is a shaft column having a reverse hook, the shaft column upward extending from an end face of the projecting section, while the engagement section of the rotary cap is a shaft hole formed on top wall of the cavity, the shaft column being rotatably fitted in the shaft hole.

10. The screwdriver structure as claimed in claim 9, wherein the engagement section has a hollow inner cylinder section so as to provide a compressing space in the installation process.

11. The screwdriver structure as claimed in claim 9, wherein the rotary cap has four through holes, the projection sections has four holes and the handle has four axial ribs.

* * * * *